US006165284A

United States Patent [19]

Shubkin

[11] Patent Number: 6,165,284

[45] Date of Patent: Dec. 26, 2000

[54] METHOD FOR INHIBITING TARNISH FORMATION DURING THE CLEANING OF SILVER SURFACES WITH ETHER STABILIZED, N-PROPYL BROMIDE-BASED SOLVENT SYSTEMS

[75] Inventor: Ronald L. Shubkin, Baton Rouge, La.

[73] Assignee: Albemarle Corporation, Richmond, Va.

[21] Appl. No.: 09/104,898

[22] Filed: Jun. 25, 1998

[51] Int. Cl.[7] ..... B08B 7/00

[52] U.S. Cl. ..... 134/38; 510/175; 510/255; 510/256; 510/258; 510/273; 510/401; 510/407

[58] Field of Search ..... 510/412, 175, 510/255, 256, 258, 273, 401; 134/38; 252/364

[56] References Cited

U.S. PATENT DOCUMENTS

| | | | |
|---|---|---|---|
| 5,403,507 | 4/1995 | Henry | 252/170 |
| 5,415,907 | 5/1995 | Inoue et al. | 428/36.2 |
| 5,492,645 | 2/1996 | Oshima et al. | 252/171 |
| 5,514,838 | 5/1996 | Wen et al. | 174/257 |
| 5,609,704 | 3/1997 | Hayama et al. | 156/89 |
| 5,616,549 | 4/1997 | Clark | 510/412 |
| 5,660,708 | 8/1997 | Tezuka et al. | 205/205 |
| 5,665,170 | 9/1997 | Lee et al. | 134/19 |
| 5,792,277 | 8/1998 | Shubkin et al. | 134/19 |
| 5,814,595 | 9/1998 | Flynn et al. | 510/411 |
| 5,827,812 | 10/1998 | Flynn et al. | 510/411 |
| 5,858,953 | 1/1999 | Aman et al. | 510/412 |
| 5,938,859 | 8/1999 | Clark et al. | 134/31 |

FOREIGN PATENT DOCUMENTS

| | | |
|---|---|---|
| 61-19700 | 1/1986 | Japan . |
| 62-7798 | 1/1987 | Japan . |
| 62-50490 | 3/1987 | Japan . |
| 7-292393 | 11/1995 | Japan . |
| 8-67643 | 3/1996 | Japan . |

OTHER PUBLICATIONS

Chemical Abstracts, AN 108:13636, "Surface plasmon detection of surface contamination of metallic film surfaces", Zhang et al., 1987.

*Primary Examiner*—Necholus Ogden
*Attorney, Agent, or Firm*—E. E. Spielman, Jr.

[57] ABSTRACT

Silver tarnishing is inhibited when using ether stabilized, n-propyl bromide based cleaning compositions by including a saturated aliphatic alcohol in the compositions.

16 Claims, No Drawings

METHOD FOR INHIBITING TARNISH FORMATION DURING THE CLEANING OF SILVER SURFACES WITH ETHER STABILIZED, N-PROPYL BROMIDE-BASED SOLVENT SYSTEMS

This invention relates generally to cleaning processes using n-propyl bromide-based cleaning solvent compositions and, more particularly, to the cleaning of articles, which have exposed silver or silver-plated surfaces, using n-propyl bromide-based cleaning solvents, without causing the silver surfaces to become tarnished.

BACKGROUND n-Propyl bromide is recognized as being an environmentally friendly solvent for cold and vapor degreasing processes. Because n-propyl bromide may be reactive to metals and its hydrolysis products may be corrosive towards metals, especially when used in vapor degreasing processes, n-propyl bromide-based cleaning solvent compositions usually include one or more stabilizers such as nitroalkanes, ethers, amines, and/or epoxides (see, for example, U.S. Pat. No. 5,616,549) and also may contain an assistant stabilizer such as an acetylene alcohol (see, for example, U.S. Pat. No. 5,492,645). One application for such cleaning compositions is the removal of residues from precision metal and electronic parts. The parts are generally cleaned using a vapor degreaser apparatus in which the part is placed in a vapor layer above the boiling solvent, such that the solvent condenses on the part and rinses away the residues. This may or may not be followed by immersion in the boiling solvent or in a sump filled with the solvent and equipped to provide ultrasonic agitation. Although n-propyl bromide has a very low tendency to tarnish silver and silver plate which used by itself, it has been found that when an ether is added to the n-propyl bromide to prevent corrosion of the metals in the parts, severe tarnishing of silver surfaces occurs in a very short time at the boiling temperature of the solvent. Cyclic ethers, such as 1,3 dioxo lane, are especially prone to promoting such tarnishing. This makes the otherwise effective and environmentally friendly, stabilized, n-propyl bromide-based cleaning solvent compositions unsuitable for use for cleaning parts which are manufactured using silver-based solder or which are silver plated to enhance their performance in end-use applications. It has now been found that such tarnish formation can be effectively inhibited by the presence of small amounts of certain saturated aliphatic alcohols in the ether containing n-propyl bromide-based cleaning solvent compositions. According to Japanese patent application JP 61019700 A2 860128, Toa Gosei Chemical Industry Co. Ltd., acetylene alcohols have been used to avoid discoloration of silver plated lead frames when vapor cleaning them with a chlorinated solvent, 1,1,1-trichloroethane, by itself, caused discoloration. Saturated aliphatic alcohols have heretofore been used with n-propyl bromide cleaning compositions as co-solvents to either reduce costs and/or to improve the removal of ionic residues, but not in the cleaning of silver surfaces in the presence of ethers in order to prevent tarnish formation.

SUMMARY OF THE INVENTION

In accordance with this invention, there is provided a method for inhibiting tarnish formation when contacting a silver surface with an ether-containing n-propyl bromide-composition, said method comprising including in said cleaning composition at least one saturated aliphatic alcohol which is effective to inhibit the tarnishing of the silver surface.

Also provided is a stabilized n-propyl bromide-based solvent composition which is useful in the process of the invention and which exhibits low pilot flame enhancement in the open cup ignition test (ASTM D-1310). The solvent composition comprises:

(a) n-propyl bromide, (b) ether, and (c) a silver tarnish inhibiting amount of a saturated aliphatic alcohol, wherein said ether and alcohol are present in said composition in a combined amount of no greater than about 6.0 weight percent, based on the total weight of solvent composition.

DETAILED DESCRIPTION

The n-propyl bromide for use in the process of the invention is, preferably, at least about 98% pure and, more preferably, the n-propyl bromide is supplied to the composition as 99+ wt. % n-propyl bromide, with the most common impurity being isopropyl bromide. The weight percentages of n-propyl bromide which are recited in this specification are based on the total weight of n-propyl bromide and impurities. The isopropyl bromide impurity is naturally found in the raw n-propyl bromide product, but its presence can be attenuated by distillation. It is not a benign impurity as it is very much less stable than n-propyl bromide and, thus, can result in aggressive corrosion. For vapor degreasing and cleaning, the isopropyl bromide content should be kept low, for example within the range of from about 0.01 to about 0.5 wt. %. n-Propyl bromide can be purchased commercially from Albemarle Corporation, Richmond, Va.

Metals such as aluminum, magnesium and titanium can catalyze the dehydrohalogenation of the n-propyl bromide to produce corrosive materials such as HBr. Therefore, the cleaning compositions also include a stabilizer system for the n-propyl bromide. The stabilizer system preferably is present in amounts of from about 1 to about 8 wt. % based on the total weight of cleaning composition.

Ethers are used in the stabilizer systems as metal passivators. Non-limiting examples of ether passivators include 1,2-dimethoxyethane, 1,4-dioxane, 1,3-dioxolane, diethyl ether, diisopropyl ether, dibutyl ether, trioxane, alkyl cellosolves in which the alkyl group has 1 to 10 carbon atoms such as methyl cellosolve, ethyl cellosolve and isopropyl cellosolve, dimethyl acetal, γ-butyrolactone, methyl t-butyl ether, and tetrahydrofuran. The ethers are present either singularly or in the form of a mixture of two or more of them, preferably in amounts of from about 1.0 to 5.0 wt. % based on the total weight of cleaning composition.

Beside ethers, the stabilizer systems generally include one or more other compounds including additional metal passivators and, also, acid acceptors. Non-limiting examples of suitable types of these other compounds for use in stabilizing the n-propyl bromide-based cleaning compositions include epoxides, nitroalkanes and amines.

Non-limiting examples of epoxides include epichlorohydrin, propylene oxide, butylene oxides, cyclohexene oxide, glycidyl methyl ether, glycidyl methacrylate, pentene oxide, cyclopentene oxide and cyclohexene oxide. They are usable either singularly or in the form of a mixture of two or more of them.

Non-limiting examples of nitroalkanes include nitromethane, nitroethane, 1-nitropropane, 2-nitropropane and nitrobenzene. They are usable either singularly or in the form of a mixture of two or more of them.

Non-limiting examples of amines include hexylamine, octylamine, 2-ethylhexylamine, dodecylamine, ethylbutylamine, hexylmethylamine, butyloctylamine, dibutylamine, octadecylmethylamine, triethylamine, tributylamine, diethyloctylamine, tetradecyldimethylamine, diisobutylamine, diisopropylamine, pentylamine, N-methylmorpholine, isopropylamine, cyclohexylamine, butylamine, isobutylamine, dipropylamine, 2,2,2,6-tetramethylpiperidine, N,N-diallyl-p-phenylenediamine, diallylamine, aniline, ethylenediamine, propylenediamine, diethylenetriamine, tetraethylenepentamine, benzylamine, dibenzylamine, diphenylamine and diethylhydroxyamine. They are usable either singularly or in the form of a mixture of two or more of them.

When present, preferred amounts of each type of these other stabilizer compounds include from about 0.05 to about 1.0 wt. % epoxide, from about 0.05 to about 1.0 wt. % nitroalkane and from about 0.05 to about 1.0 wt. % amine, with each of the above percentages being based on the total weight of cleaning composition.

The saturated aliphatic alcohols for use as tarnish inhibitors in the process of the invention are, preferably, straight and branched chain $C_1$ to $C_{10}$ saturated aliphatic alcohols. Non-limiting examples of such alcohols include 1-propanol, 2-propanol, 1-butanol, 2-1butanol, tert-butanol, 2-methylpropan-1-ol, 2-methylbutan-1-ol, 1,2-dimethylpropan-1-ol, 1,1-dimethylpropane-1-ol, and the like. The more preferable alcohols are those which contain 3–5 carbons. The saturated aliphatic alcohols are used, either singly or in combination, in tarnish inhibiting amounts of, preferably, from about 0.1 to about 15.0 wt. %, and more preferably, from about 1.0 to about 10.0 wt. %, based on the total weight of cleaning composition.

Where a very low flammability solvent composition must be provided, as evidenced by low pilot flame enhancement in the standard open cup ignition test (ASTM D-13 10), it has been found that the combined total of ether and alcohol should be kept below about 6 wt. %. Alcohol contents of from about 1.5 to about 3.5 wt. % and ether contents of from about 1.5 to about 2.5 wt. % achieve this purpose while providing, especially in the case of a 1-propanol and 1,3-dioxolane combination, a very effective, non-tarnishing, non-corrosive cleaning composition for silver-containing parts.

Besides the stabilizer system and alcohol(s), the balance of the n-propyl bromide-based cleaning composition will, preferably, be the n-propyl bromide cleaning solvent. However, the solvent portion may also include co-solvents in amounts which do not cause the cleaning solvent composition to have a flash point or otherwise harm the safety and efficiency of the cleaning composition. Examples of such co-solvents include hydrocarbons, fluorocarbons, hydrofluorocarbons, hydrofluoroethers, chlorocarbons, hydrochlorocarbons, fluorochlorocarbons and hydrochlorofluorocarbons. Generally, the n-propyl bromide will constitute at least about 50 wt. % percent, and more preferably, at least about 80 wt. % of the cleaning solvent composition.

The alcohol additives are especially useful for tarnish prevention in cleaning processes where the parts are immersed in hot solvent or solvent vapors, but they are also effective with cleaning processes in cold solvent and where solvent immersion is used in conjunction with agitation.

The invention is further illustrated by, but is not intended to be limited to, the following examples.

EXAMPLE 1

Sheets of silver-plated steel were cut into coupons approximately 3 inches long and 0.5 inches wide. A hole was punched in one end of each coupon. In order to, determine the relative amount of tarnish formation with different n-propyl bromide solvent formulations, 125 ml Erlenmeyer flasks were filled with 50 ml of the test solvent. One silver-plated coupon was placed in each flask with the punched hole at the top. Approximately ¾ inch to 1 inch of each coupon was submerged beneath the surface of the solvent. Each flask was attached to a vater-cooled condenser and placed on a heating mantle. The time to heat the solvent to boiling (71° C.) was approximately 5 minutes. Total time for the test was 15 minutes (ca. 10 minutes at boiling). The flasks were raised from the heating mantles and allowed to cool for about one minute. The condensers were removed from the flasks and the coupons were removed from the solvent with a pair of tweezers. The coupons were numbered with a black marker after they were removed from the solvent. Digital photos were taken of each coupon to document the degree of tarnish. The composition of the test solvents is given in Table I. In each case, the balance of the solvent composition was n-propyl bromide. The compositions that demonstrate the effect of adding an ether (1,3-dioxolane) to the cleaning solvent and the corresponding coupons are nos. 1–5. The formulations that show the effect of adding various amounts of 1-propanol to formulations containing 1,3-dioxolane and the corresponding coupons are nos. 6–8.

TABLE I

Additives in n-Propyl Bromide Formulations

| No. | 1,3-Dioxolane, wt. % | 1,2-Epoxybutane, wt. % | Nitromethane, wt. % | 1-Propanol, wt. % |
|---|---|---|---|---|
| 1 | — | — | — | — |
| 2 | — | 0.15 | — | — |
| 3 | 4.00 | 0.15 | — | — |
| 4 | — | 0.50 | 0.50 | — |
| 5 | 4.00 | 0.50 | 0.50 | — |
| 6 | 2.50 | 0.50 | 0.50 | 7.50 |
| 7 | 1.50 | 0.50 | 0.50 | 3.50 |
| 8 | 1.50 | 0.50 | 0.50 | 2.50 |

Results

The tarnish observed on each coupon at the conclusion of the test may be qualitatively described as:

1. Control—No Clean—No tarnish.
2. No Dioxolane—Very light yellowing below surface of solvent (barely visible).
3. 4% Dioxolane—Very dark tarnish below surface of solvent.
4. No Dioxolane—No tarnish.
5. 4% Dioxolane—Very dark tarnish below surface of solvent.
6. 2.5% Dioxolane+7.5% 1-propanol—Very light yellowing below surface of solvent (barely visible).
7. 1.5% Dioxolane+3.5% 1-propanol—No tarnish.
8. 1.5% Dioxolane+2.5% 1-propanol—No tarnish.

n-Propyl bromide by itself or with an epoxy and/or nitromethane stabilizer has a very low tendency to tarnish silver and silver plate as shown by coupon nos. 1, 2 and 4. The addition of a commonly used metal passivator based on an ether structure (specifically 1,3-dioxolane) causes severe tarnishing in a short period of time at the boiling temperature of the solvent as shown by coupon nos. 3 and 5. As shown by coupon nos. 6–8, the addition of amounts of from 2.5 to 7.5 wt. % of 1-propanol were effective to prevent tarnishing of the silver in the presence of the ether.

EXAMPLE 2

The cleaning of lead frames, each having fifteen copper prongs attached with a white-silver coated area an each prong, was carried out using a Branson Vapor degreaser (5 gallon capacity) equipped with ultrasonics (40 MHz) in the rinse sump. Two cleaning procedures were used with the second procedure including the immersion of the test parts in the boiling solvent so as to provide a more severe cleaning environment. The more severe environment further demonstrated the advantages provided by the cleaning process of the invention.

For each cycle of cleaning, ten parts were placed in a rack in a steel basket. The parts were placed so that they stood on edge, with the white-silver coated prongs at the top. The basket was then moved through each step of the cleaning cycle.

Each of the two cleaning procedures were first run (Cycles I and II in Table II) using a cleaning solvent composition of 95 wt. % n-propyl bromide, 4.0 wt. % dioxolane, 0.5 wt. % 1,2-epoxybutane and 0.5 wt. % nitroethane. Each of the two cleaning cycles were then repeated (Cycles III and IV) after cooling, draining and recharging the vapor degreaser with a cleaning solvent composition of 91 wt. % n-propyl bromide, 2.5 wt. % dioxolane, 0.5 wt. % 1,2-epoxybutane, 0.5 wt. % nitroethane and 7.5 wt. % 1-propanol. The cleaning cycles for each procedure were as follows:

Procedure 1

1. Hang basket in vapor zone for 40 seconds;
2. Place basket in warm rinse sump with ultrasonics for 3 minutes;
3. Shut off ultrasonics and rinse for 15 seconds;
4. Hang in vapor zone for 4 minutes;
5. Dry in air for approximately 2 minutes;
6. Place in plastic bag with zip top closure.

Procedure 2

1. Hang basket in vapor zone for 40 seconds;
2. Place in boil-up sump for 3 minutes (70° C.);
3. Place in warm rinse sump with ultrasonics for 3 minutes;
4. Shut off ultrasonics and rinse for 15 seconds;
5. Hang in vapor zone for 4 minutes;
6. Dry in air for approximately 2 minutes;
7. Place in plastic bag with zip top closure.

Photomicrographs of the cleaned parts were taken to provide a visual comparison of the prongs on the parts cleaned by the composition used in cycles I and II with the prongs on the parts cleaned by the composition used in cycles III and IV. The results are described in Table II.

TABLE II

| Cycle | Procedure | Observations |
|---|---|---|
| I | 1 | Visible Darkening |
| II | 2 | Severe Darkening |
| III | 1 | No Darkening |
| IV | 2 | No Darkening |

The results described in Table II demonstrate that the process of the invention prevented silver tarnishing that would otherwise occur when using ether containing n-propyl bromide cleaning compositions, even in a severe cleaning environment.

What is claimed is:

1. A method for inhibiting tarnish formation when contacting a silver surface with an n-propyl bromide-based cleaning composition which contains a cyclic ether passivator, said method comprising including in said cleaning composition at least one saturated aliphatic alcohol containing from 3–5 carbons, which alcohol is effective to inhibit the tarnishing of said silver surface.

2. The method of claim 1 wherein the amount of said alcohol present is from about 0.1 to about 15.0 weight percent, based on the total weight of cleaning composition.

3. The method of claim 1 wherein the amount of said alcohol present is from about 1.0 to about 10.0 weight percent, based on the total weight of cleaning composition.

4. The method of claim 1 wherein said cyclic ether is 1,3-dioxolane.

5. The method of claim 1 wherein said alcohol is selected from the group consisting of 1-propanol, 2-propanol, 1-butanol, 2-butanol, tert-butanol, 2-methylpropan-1-ol, 2-methylbutan-1-ol, 1,2-dimethylpropan-1-ol, and 1,1-dimethylpropane-1-ol, including mixtures thereof.

6. The method of claim 4 wherein said alcohol is 1-propanol.

7. A process for cleaning an electronic part which includes a silver containing surface, without causing said surface to become tarnished, said process comprising contacting said part with a cyclic ether passivator containing n-propyl bromide-based cleaning composition which contains a tarnish inhibiting amount of at least one saturated aliphatic alcohol having from 3–5 carbons, which alcohol is effective to prevent silver tarnishing which would otherwise occur due to the presence in said composition of said cyclic ether.

8. The process of claim 7 wherein said cleaning composition contains from about 0.1 to about 15.0 weight percent of said alcohol, based on the total weight of cleaning composition.

9. The process of claim 7 wherein said cleaning composition contains from about 1.0 to about 10.0 weight percent of said alcohol, based on the total weight of cleaning composition.

10. The process of claim 7 wherein said part is contacted with hot vapor above said cleaning composition which has been heated to boiling.

11. The process of claim 7 wherein said part is immersed in said cleaning composition at its boiling temperature.

12. The process of claim 7 wherein said part is immersed in said cleaning composition at a temperature which is less than its boiling temperature.

13. The process of claim 7 wherein said part is immersed in said cleaning composition and subjected to ultrasonic agitation.

14. The process of claim 10 wherein the combined amount of said ether and said alcohol is no greater than about 5.0 weight percent, based on the total weight of cleaning composition.

15. The process according to claim 1 wherein said cyclic ether is selected from the group consisting of 1,4-dioxane, 1,3-dioxolane, trioxane, γ-butyrolactone, and tetrahydrofuran.

16. The process according to claim 7 wherein said cyclic ether is selected from the group consisting of 1,4-dioxane, 1,3-dioxolane, trioxane, γ-butyrolactone, and tetrahydrofuran.

* * * * *

UNITED STATES PATENT AND TRADEMARK OFFICE

CERTIFICATE OF CORRECTION

PATENT NO. : 6,165,284
DATED : December 26, 2000
INVENTOR(S) : Ronald L. Shubkin It is certified that error appears in the above-identified patent and that said Letters Patent is hereby corrected as shown below:

Column 6,
Line 52, reads "... of claim 10 ..." and should read -- of claim 7 ... --.

Signed and Sealed this

Eighteenth Day of December, 2001

*Attest:*

*Attesting Officer*

JAMES E. ROGAN
*Director of the United States Patent and Trademark Office*